US007309825B2

(12) United States Patent
Lynch

(10) Patent No.: US 7,309,825 B2
(45) Date of Patent: Dec. 18, 2007

(54) GUITDOORBELL ENTRY SIGNAL STRINGED INSTRUMENT DOOR CHIME

(76) Inventor: David B Lynch, 3248 J. St., Sacramento, CA (US) 95816

( * ) Notice: Subject to any disclaimer, the term of this patent is extended or adjusted under 35 U.S.C. 154(b) by 0 days.

(21) Appl. No.: 11/363,590

(22) Filed: Feb. 27, 2006

(65) Prior Publication Data

US 2007/0199428 A1 Aug. 30, 2007

(51) Int. Cl.
*G11D 13/08* (2006.01)

(52) U.S. Cl. ..... 84/402

(58) Field of Classification Search ..... 84/320–322, 84/402–410

See application file for complete search history.

(56) References Cited

U.S. PATENT DOCUMENTS 2,705,936 A * 4/1955 Garson ..... 116/100
2005/0279403 A1* 12/2005 Kube ..... 136/291

* cited by examiner

*Primary Examiner*—Kimberly Lockett

(57) ABSTRACT

A dual element door chime assembly, positioning pick and fixed mount miniature guitar door chime, which provides musical, door opening audible indication and visual guitar decorative theme. The apparatus can be easily adapted to various sizes of doors and a plethora of doorway entry designs. The apparatus is comprised of a movable guitar pick and stationary fixed mount inverted miniature guitar, constructed of a spring-door stopper pick rotating about a horizontal plane and a fixed mount, wooden miniature guitar with metal string assembly.

4 Claims, 5 Drawing Sheets

GUITDOORBELL ENTRY SIGNAL STRINGED INSTRUMENT DOOR CHIME

BACKGROUND

1. Field of the Disclosure

The present invention relates to door opening, signaling and musical chimes. More particularly, the present invention is a miniature guitar shaped fixed mount chime element and traveling plectrum striker pick. It is necessary for the plectrum, traveling striker pick to be spring actuated and properly aligned with the fixed mounted miniature guitar shaped door chime assembly, in order to effectuate the door opening signal. If the two elements are not properly aligned the striker pick will not properly engage the miniature guitar door chime strings and no door opening signal will result.

2. The Prior Art

BACKGROUND

Traditional door chimes are known in the art. One known type of door chime devices consists of a box and switch assembly actuating a recorded musical tone, series of tones or message. The signaling sound is created when the wall-housing aperture separates from the door chime assembly. Selecting one, of two or more, different housing covers, can alter the door chime assembly appearances and associated acoustic properties. Changing the shape and or size of the internal resonating elements within the housing unit alters the sound.

Another kind of known door chime is a simple wind chime fixed mounted to an opening door. This device indicates that the door has been opened, but does not utilize the unique sound and functional mechanisms of an actual miniature guitar to signal that the door has been opened.

BRIEF DESCRIPTION OF THE DRAWING FIGURES

DETAILED DESCRIPTION

Figure 1:
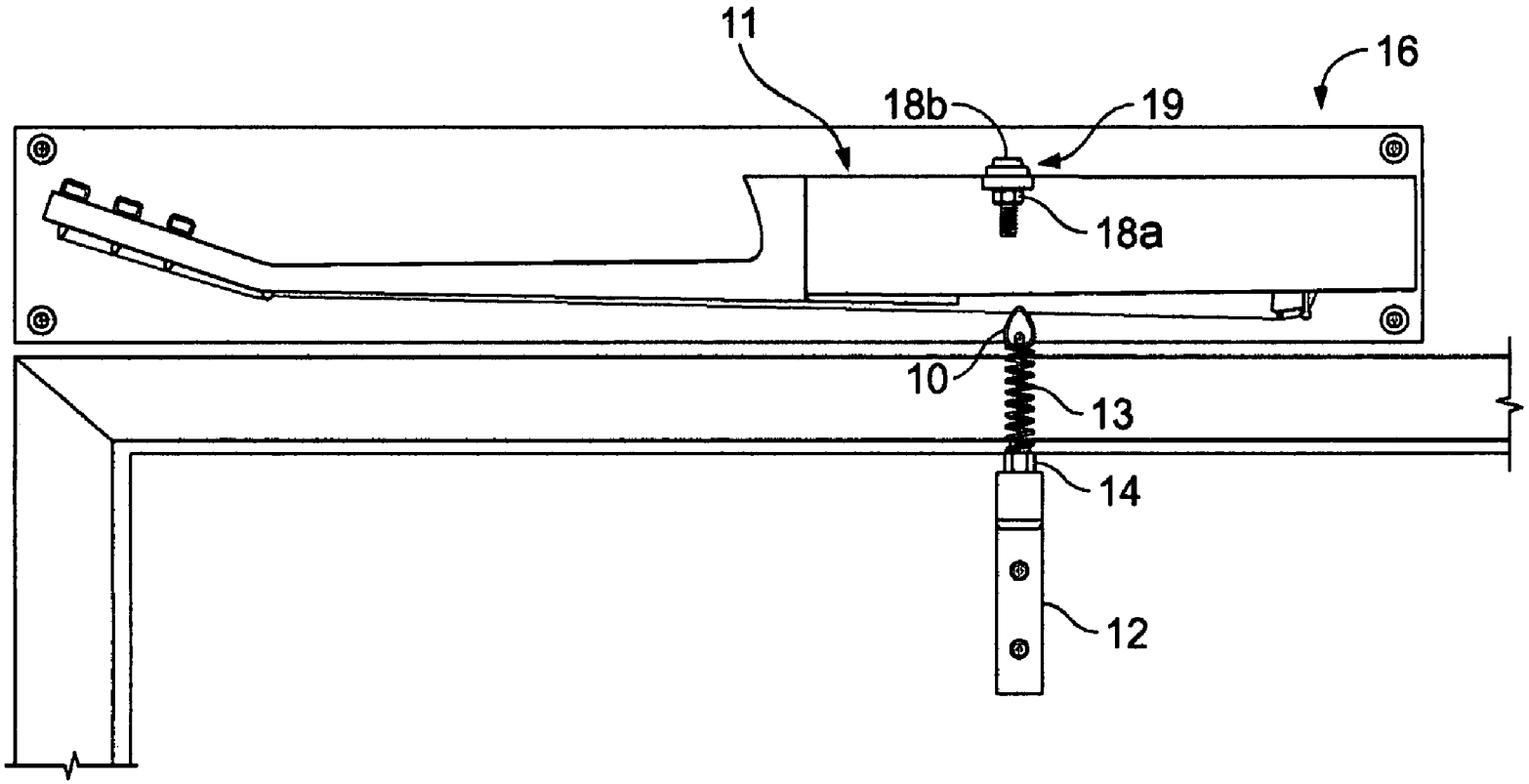
FIG. 1 is a Guitdoorbell with plectrum arm mounted pick and mounted miniature guitar front view.

Persons of ordinary skill in the art will realize that the following description is illustrative only and not in any way limiting. Other modifications and improvements will readily suggest themselves to such skilled persons having the benefit of this disclosure. In the following description, like reference numerals refer to like elements throughout.

Accordingly, it is a primary object of the present invention to provide a dual element door chime assembly, positioning pick and fixed mount miniature guitar door chime which provides musical, door opening audible indication and a visual guitar decorative theme.

It is yet another object of this invention to provide a means to signal a door opening utilizing a musical guitar shaped, door chime and a festive guitar musical theme.

It is yet another object of this invention to provide a method of door opening signaling and festive guitar musical theme door chime.

It is yet another object of this invention to provide a means for adapting the door chime to various sizes of doors and a plethora of entry doorway designs.

To attain these objects, the present invention discloses a new Guitdoorbell, entry signal miniature guitar shaped door chime and traveling plectrum arm striker pick. The present embodiment is a miniature guitar shaped fixed mount chime element and traveling plectrum striker pick assembly. It is necessary for the plectrum traveling striker pick (heretofore plectrum) to be spring mounted and properly aligned with the fixed mounted miniature guitar (heretofore guitar) shaped door chime assembly, in order to allow the striker pick to properly contact resonating strings of miniature guitar chime element to effectuate the door opening signal. If the two elements are not properly aligned the striker pick will not properly engage the miniature guitar door chime strings and no door opening signal will result.

According to the teaching of the invention the entry signal miniature guitar shaped door chime engages a fixed mount miniature guitar strings assembly element by a angular, flexible plectrum arm striker pick that is caused to travel by a swinging plane surface pivoting about a vertical axis parallel to door hinges. The plectrum arm striker pick is caused to flex and move across each guitar string to create the door chime musical door opening indication. The plectrum shall be positioned on the top leading outer edge of moving door just below and in proximity to the vibrating chime strings of the guitar so that the tip of the plectrum extends into the physical proximity of the guitar strings by no less than $1/16^{th}$ inch and no more than ½ inch, for proper sounding of guitar strings as traveling plectrum on moving, opening or closing door affects the flexible assembly to disturb and actuate the guitar strings. The actuating occurs by causing guitar strings to resonate and sound freely in the tuning of E7 suspended, or a variety of other user guitar string tunings as desired by user.

FIG. 1 is a Guitdoorbell with plectrum arm mounted pick and mounted miniature guitar front view.

By properly aligning the plectrum arm mounted pick 10 with the mounted inverted miniature guitar 11 an E7 Suspension Chord, or a variety of user guitar string tunings, the apparatus signals the door opening. The screw base 14 and plectrum arm mounted pick assembly is fastened to a first angle bracket and attached to a door frame and aligned to the inverted miniature guitar to facilitate the appropriate pick engagement with miniature guitar strings by use of apparatus alignment hardware through the use of said first angle bracket, a second angle bracket and said plectrum arm mounted pick assembly. A mounting board directly adjacent to the doorjamb receives said second angle bracket horizontal brace rigidly fastened to said inverted miniature guitar or other stringed instrument thereto on an outer first end of said second angle bracket. Said second angle bracket is thereby fastened to said mounting board on an inner second end of the second angle bracket. The mounting board is further attached to a mounting surface through the use of a multiplicity of mounting means to support the combined weight and torque of said Guitdoorbell door chime apparatus and signal.

Figure 2A:
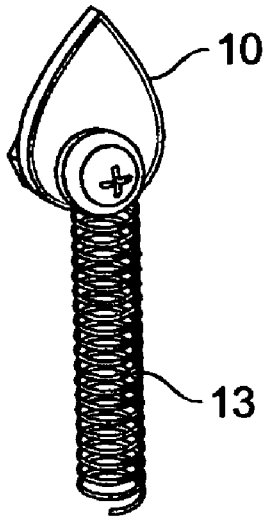
FIG. 2A is a detailed view of the components of the plectrum arm mounted pick assembly.

FIG. 2A is a front detail view of the plectrum arm-mounted pick assembly, mounting board, doorjamb, horizontal brace, inverted signaling guitar and apparatus alignment hardware.

Figure 2B:
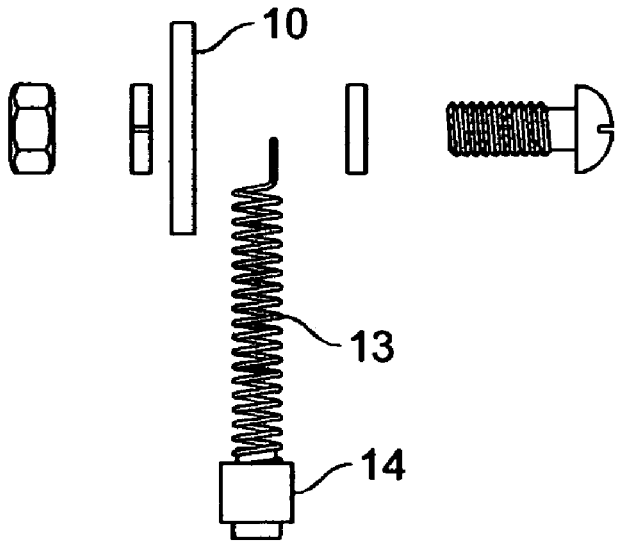
FIG. 2B is a detailed front view of the plectrum arm mounted pick assembly.

FIGS. 2A and 2B are one embodiment of the Guitdoorbell plectrum arm mounted pick assembly. Mounting 12 the pick 10 on a spring 13 onto an eyelet with a screw base 14 allows the pivoting pick action when the door is opened to 'strum' across the strings of the miniature guitar thereby creating the Guitdoorbell chime apparatus and signal. The pick is thereby rigidly attached to said spring and eyelet through a multiplicity of fastening or bonding means including screws, rivets or adhesives. Said spring shall be anchored to a block of material shaped to receive said doorjamb and also rigidly attached through said fastening means. Said block of material shaped to receive said doorjamb will further be fastened to said first angle bracket on an upper first end of said bracket and fastened to a door frame on a lower second end of said first angle bracket.

Figure 3A:
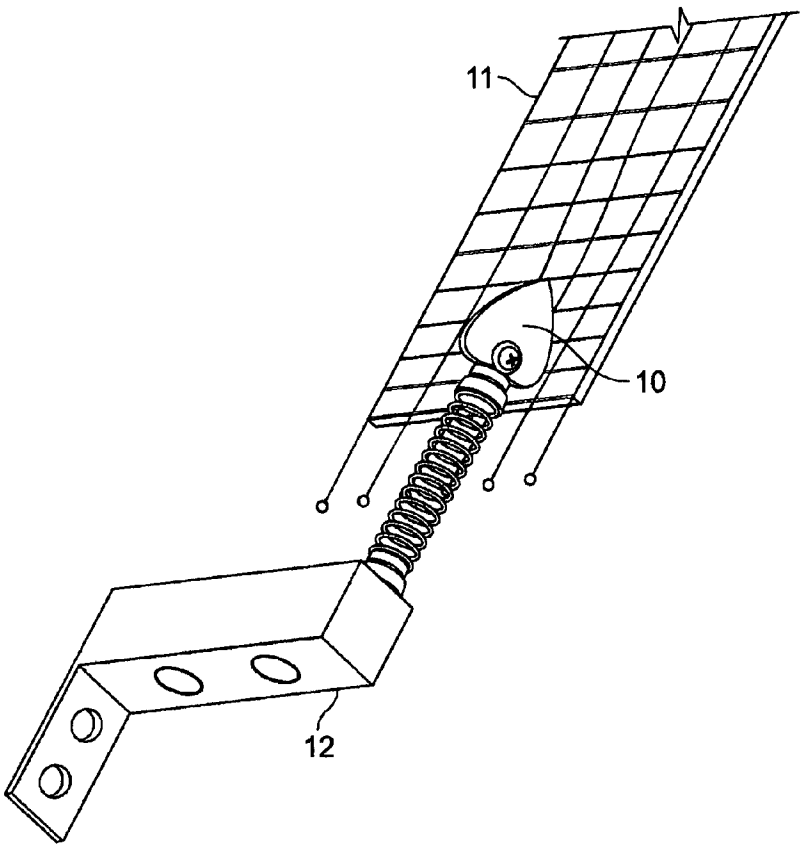
FIG. 3A is a traveling striker pick plectrum arm and fixed mounted miniature guitar strings detail view.
Figure 3:
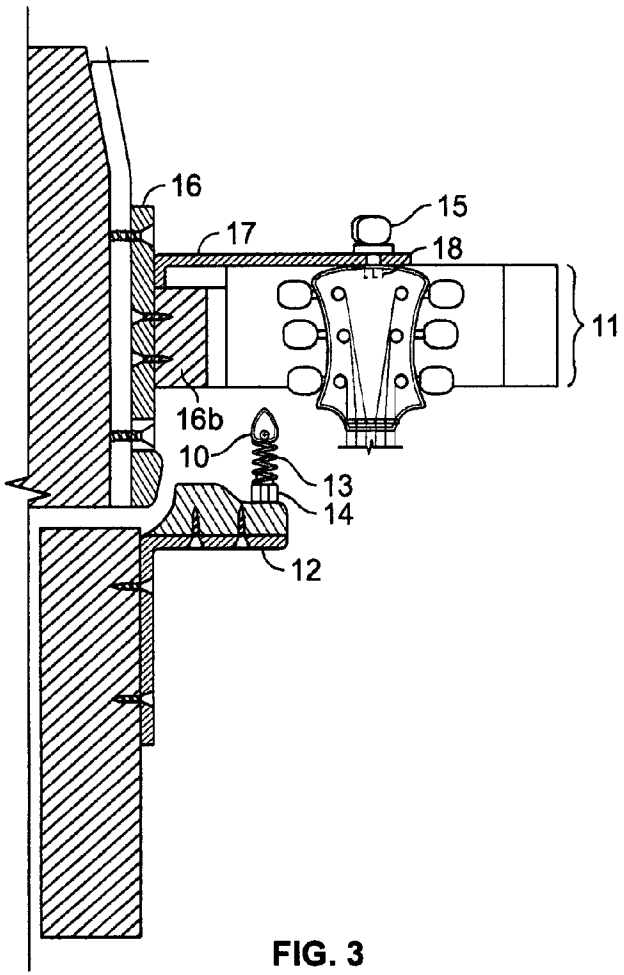
FIG. 3 is a Guitdoorbell with plectrum arm mounted pick and mounted miniature guitar side view.

FIG. 3 is a Guitdoorbell with plectrum arm mounted pick and mounted miniature guitar or stringed instrument side view.

FIG. 3 shows a side view of the embodiment of how the two elements are aligned and mounted. A thumb screw 15 secures the guitar 11 to mounting board 16 by passing through a "L" bracket 17, right angled metal or other material fastener which is affixed at one side to the mounting board 16 (by epoxy or other means). Further, by passing through the small hole in the back of guitar to a threaded nut 18*a* which is affixed by thumb screw 18*b* to a structural reinforcing brace 19 within the guitar interior back with an epoxy or other securing material adhesive or fixing apparatus. The plectrum assembly is a guitar or strings instrument "pick" 10 of heavy to medium thickness and of sufficient size to make clear contact with the guitar strings 11. The plectrum pick assembly is affixed to a door stopper type spring 13 modified to have an eyelet in which to secure the plectrum 10 with a nut, screw 14 and washers. This is then threaded into a block of material that is affixed to an "L" bracket 12. The "L" bracket 12 is mounted to the door that supports the spring and plectrum assembly. The entire assembly is affixed to the door and properly adjusted to strike the strings in an even fashion and thus causes the strings of the mounted miniature guitar 11 (or other stringed instrument such as mandolin, violin, cello, banjo) to sound.

FIG. 3A is a traveling striker pick plectrum arm and fixed mounted miniature guitar strings detail view.

FIG. 3A embodies the signaling method and illustrates how the striker pick 10 moves the strings of the guitar 11 and thereby creates a stringed instrument that is vibrated, causing the door chime sound.

Figure 4:
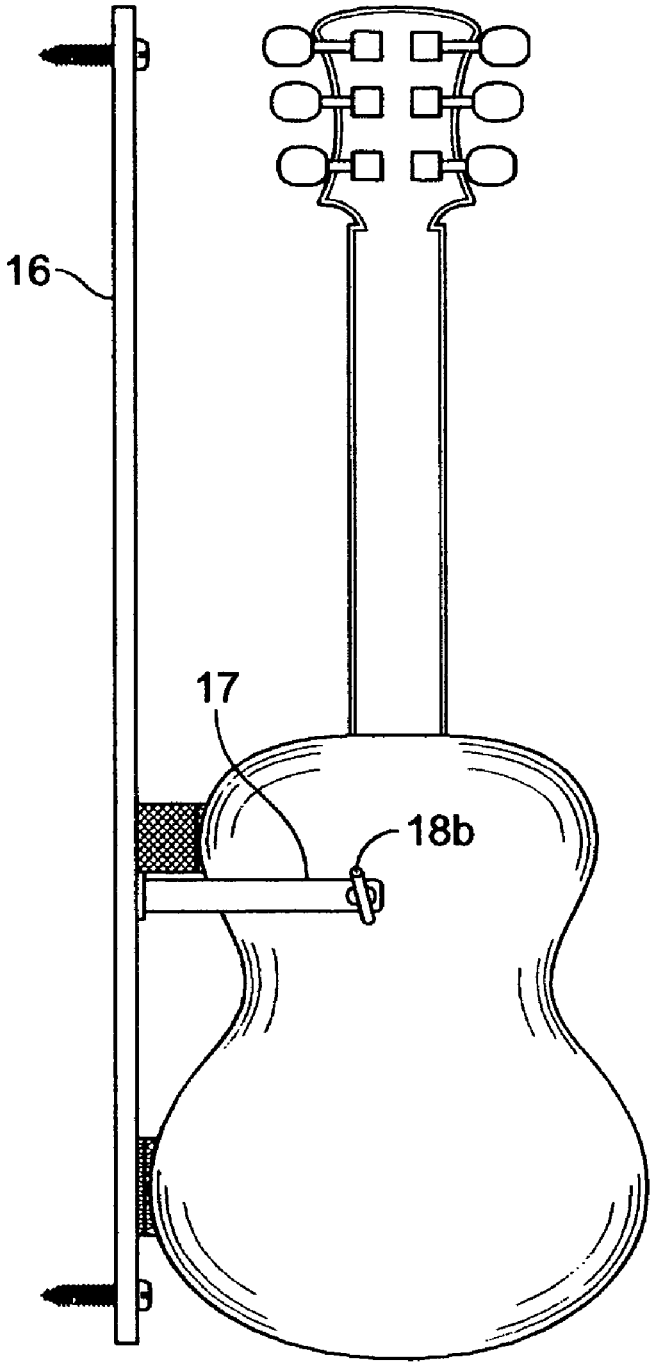
FIG. 4 is a Guitdoorbell with mounted miniature guitar top view.

FIG. 4 is a Guitdoorbell with mounted miniature guitar top view.

FIG. 4 shows one embodiment of the mounted miniature guitar element of the invention, the second "L" bracket 17 suspends miniature guitar chime to mounting board 16 and still allows for removal. This second "L" bracket 17 is attached by a thumb screw 18*b* through a lock washer, then through a hole in the back of the miniature guitar is fixed to an epoxy glued nut 18*a* residing inside the resonating chamber of the miniature guitar.

Figure 5:
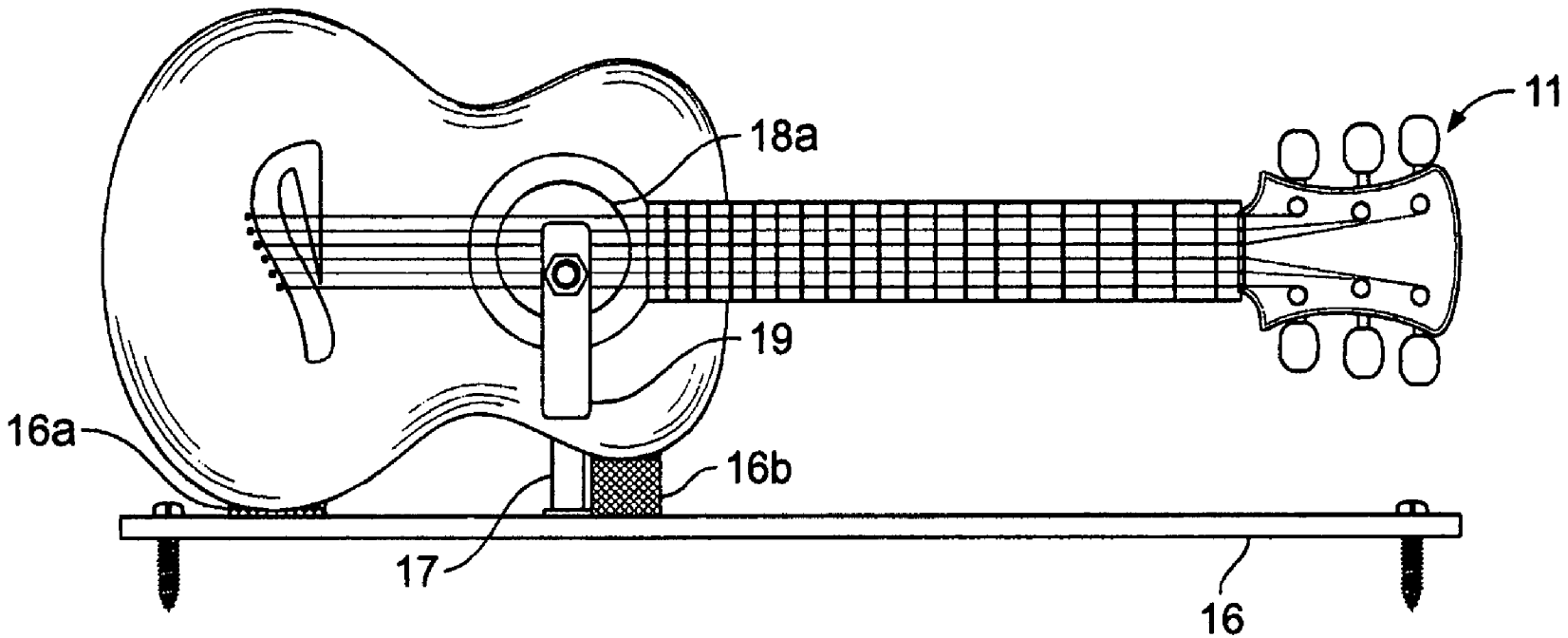
FIG. 5 is a Guitdoorbell with mounted miniature guitar bottom view.

FIG. 5 is a Guitdoorbell with mounted miniature guitar bottom view.

FIG. 5 depicts one embodiment where the dual Velcro side attachments combine with the internal braces to secure the miniature guitar to allow the guitar chime to be removed for cleaning, tuning or playing in a traditional fashion. The first Velcro attachment 16*a* is placed 4 inches from the bottom of the guitar on the side of the mounting board 16. The second Velcro attachment 16*b* is placed an additional 11 and ¾ inches further up the mounting board on the side of the guitar 11 next to the "L" bracket 17 that extends into the center of the guitar as described above under FIG. 4. The Velcro is placed at the end of a 1 and $\frac{1}{8}^{th}$ inch by 1 inch by 3 inch upper boot support 16*b*. The boot support is attached to the mounting board with a screw.

While embodiments and applications of this disclosure have been shown and described, it would be apparent to those skilled in the art that many more modifications and improvements than mentioned above are possible without departing from the inventive concepts herein. The disclosure, therefore, is not to be restricted except in the spirit of the appended claims.

What is claimed is:

1. A dual element door chime assembly, positioning pick and fixed mount miniature guitar door chime, comprising:

a fixed mount miniature guitar-stringed stationary musical instrument element, a plectrum arm, a traveling striker pick fastened to a pivotally attached opening door, a front panel, a side panel, a top panel, and a bottom facing panels, wherein said front, side, top, and bottom panels are rigidly attached to a mounting bracket, plectrum arm, and right angle pin forming a substantially solid rectangular block to support a formed, spring assembly, said substantially solid rectangular block support fastened and clasped to said formed, spring assembly, said mounting bracket fastened to said substantially solid rectangular block support on the opposite end of the solid support from the formed, spring assembly and the mounting bracket fastened to a door frame on its opposite end, the plectrum arm formed via a door stopper spring device and eyelet with a screw base, the plectrum arm threaded screw length attached to the solid support utilizing a nut and threaded insert, said plectrum arm attached on an opposite end to the traveling striker pick utilizing the eyelet and fastening means.

2. The apparatus of claim 1 further comprising:

a means for door opening door chime signalling and operation wherein said door chime signalling is provided utilizing a manually aligned guitar and pick assembly such that the manually aligned assembly engages the pick with the instrument strings.

3. The apparatus of claim 1, further comprising:

a said fixed mount miniature guitar-stringed stationary musical instrument element is selected from the group consisting of a miniature guitar, mandolin, banjo or other stringed instrument.

4. A method for indicating door opening comprising the steps of:

indicating proper door opening signalling;

preventing improper plectrum arm striker pick positioning; and facilitating proper plectrum arm and miniature guitar string engagement wherein door opening signalling, plectrum arm striker pick positioning, and plectrum arm guitar string engagement is provided utilizing a manually aligned guitar and pick assembly such that the manually aligned assembly engages the pick with the instrument strings.

* * * * *